US005713269A

United States Patent [19]

Maurer

[11] Patent Number: 5,713,269

[45] Date of Patent: Feb. 3, 1998

[54] REFUSE ASSEMBLY FOR REDUCING THE SIZE OF DEFORMABLE OBJECTS

[75] Inventor: Dennis Maurer, Harrington, Wash.

[73] Assignee: Recycling Equipment, Spokane, Wash.

[21] Appl. No.: 631,220

[22] Filed: Apr. 11, 1996

[51] Int. Cl.[6] ..... B30B 15/32

[52] U.S. Cl. ..... 100/45; 100/152; 100/902

[58] Field of Search ..... 100/45, 151, 152, 100/902

[56] References Cited

U.S. PATENT DOCUMENTS

| | | | |
|---|---|---|---|
| 2,959,364 | 11/1960 | Anderson et al. | 100/151 |
| 3,691,942 | 9/1972 | Wagley | 100/151 |
| 3,776,128 | 12/1973 | Morris | 100/902 |
| 3,887,314 | 6/1975 | Andresen et al. | 100/152 |
| 4,059,050 | 11/1977 | Davis, Jr. | 100/902 |
| 4,060,363 | 11/1977 | Nelson . | |
| 4,119,024 | 10/1978 | White . | |
| 4,125,069 | 11/1978 | Smith et al. . | |
| 4,463,844 | 8/1984 | Huffman et al. | 100/902 |
| 4,483,248 | 11/1984 | Ostreng . | |
| 4,995,314 | 2/1991 | Buer . | |
| 5,195,429 | 3/1993 | Firpo . | |
| 5,239,920 | 8/1993 | Schuff et al. . | |
| 5,355,788 | 10/1994 | Phinney | 100/152 |

FOREIGN PATENT DOCUMENTS

| | | | |
|---|---|---|---|
| 5-318191 | 12/1993 | Japan | 100/902 |

*Primary Examiner*—Stephen F. Gerrity
*Attorney, Agent, or Firm*—Wells, St. John, Roberts, Gregory & Matkin, P.S.

[57] ABSTRACT

A refuse assembly is disclosed and which is useful for reducing the size of deformable objects. The refuse assembly includes a frame defining a passageway, the passageway having an intake end, and an opposite, exhaust end; a pair of continuous rotatable belts mounted in converging relation, one to the other, in the passageway, the pair of continuous belts partially occluding the passageway, each of the continuous belts having an upstream end, which is movably mounted near the intake end of the passageway, and a downstream end which is substantially fixedly mounted near the exhaust end of the passageway; and an engine mounted in force transmitting relation relative to the respective continuous belts to rotate each of the continuous belts in a predetermined direction.

21 Claims, 6 Drawing Sheets

REFUSE ASSEMBLY FOR REDUCING THE SIZE OF DEFORMABLE OBJECTS

TECHNICAL FIELD

The present invention relates to a refuse assembly for reducing the size of objects of interest, and more specifically, to a refuse assembly which finds usefulness in crushing deformable objects such as all manner of fabricated metal cans and other synthetic containers.

DESCRIPTION OF THE PRIOR ART

The prior art is replete with numerous examples of refuse processing devices which are adapted to treat or otherwise manipulate a stream of recyclable refuse in such a fashion as to separate the refuse into categories of material which can be recycled using other downstream processing. In the processing of recyclable material such as containers fabricated from all manner of metal, for example, refuse handlers have employed, heretofore, various can crushing assemblies which are utilized to reduce the size of the individual metal containers such that they can be packaged, as by a baling assembly, or other similar devices, for easy handling.

While the prior art can crushing assemblies, and variations thereof have operated with varying degrees of success, they have proven to be unsatisfactory in several important respects. For example, the prior art device shown in U.S. Pat. No. 4,995,314 to Buer, relates to a can flattening device and more specifically, to a can flattening device which has, as one of its salient features, an assembly which allows a pair of continuous belts to adjustably move in spaced relationship one to the other, to prevent clogging or jamming of the machine. Still other recycling devices use various perforating and crushing rollers for reducing the volume of crushable objects such as beverage cans and other metal containers for purposes of facilitating downstream processing with bailing and other assemblies. Such is exemplified by U.S. Pat. No. 5,195,429 to Firpo.

Still another deficiency with the prior art devices results from characteristics inherent in their individual designs inasmuch as these devices do not provide a convenient means by which the machines can be protected against jamming and the damages which can be occasioned by overloading when the stream of recyclable material entering the machine reaches a high volume.

Therefore, it has long been known that it would be desirable to provide a refuse assembly which is operable to substantially reduce the time and labor required to produce a given volume of recyclable refuse with the attendant economic savings realized from such reductions, and which further provides a convenient means for controlling the refuse being recycled to avoid operational problems associated with jamming or otherwise overloading the refuse assembly.

SUMMARY OF THE INVENTION

Therefore, it is an object of the present invention to provide an improved refuse assembly for reducing the size of an object of interest.

Another object of the present invention is to provide a refuse assembly which has particular utility in reducing the size of metal containers, such as beverage cans and the like, and which is operable to deliver the reduced volume beverage cans to a predetermined destination.

Another object of the present invention is to provide such a refuse assembly which includes a frame, defining a passageway, the passageway having an intake end, and an opposite exhaust end; a pair of continuous rotatable belts mounted in converging relation, one to the other, in the passageway, the pair of continuous belts partially occluding the passageway, each of the continuous belts having an upstream end which is movably mounted near the intake end of the passageway, and a downstream end which is substantially fixedly mounted near the exhaust end of the passageway; and means mounted in force transmitting relation relative to the respective continuous belts to rotate each of the continuous belts in a predetermined direction.

Another object of the present invention is to provide such a refuse assembly which includes a first conveyor assembly which is mounted in discharging relation relative to the intake end of the passageway, the first conveyor assembly carrying the object of interest to the intake end of the passageway where they move, under the influence of gravity, into the intake end of the passageway.

Another object of the present invention is to provide a refuse assembly which includes a speed control assembly disposed in sensing relation relative to the pair of continuous rotatable belts, and which is further disposed in speed controlling relation relative to the first conveyor, and wherein the speed control assembly permits the first conveyor to move at a first given speed if a first condition is sensed at the pair of continuous rotatable belts, and further permits the conveyor to move at a second given speed if a second condition is sensed at the pair of continuous rotatable belts.

A further object of the present invention is to provide a second conveyor which is disposed in receiving relation relative to the discharge end of the passageway, the second conveyor carrying the objects of interest to a predetermined destination.

Another object of the present invention is to provide a refuse assembly which is operable to obtain the individual benefits to be derived from related prior art devices while avoiding the detriments individually associated therewith.

Further objects and advantages is to provide improved elements and arrangements thereof in an apparatus for the purposes described, and which is dependable, economical and fully effective in accomplishing its intended purposes.

These and other objects and advantages are achieved in a refuse assembly for reducing the size of deformable objects and which includes:

- a frame defining a passageway through which the objects pass, the objects moving through the passageway under the influence of gravity, the passageway having an intake end, and an opposite exhaust end;
- a pair of continuous rotatable belts mounted in the passageway, the pair of continuous belts disposed in converging relation one to the other, the individual continuous belts each having an upstream end which is located in a position which is near the intake end of the passageway, and an opposite, downstream end which is located in a position near the exhaust end of the passageway, and wherein the downstream end of the respective continuous belts are mounted in substantially fixed, spaced relation, one to the other, and the upstream ends are adjustably movable along predetermined paths of travel;
- a rotation means disposed in force transmitting relation relative to the pair of continuous belts, the rotation means rotating the continuous belts in a predetermined direction;
- a conveyor mounted in discharging relation relative to the intake end of the passageway, the conveyor carrying the objects to the passageway at a predetermined speed; and a speed control assembly disposed in sensing relation relative to the rotation means, and in speed controlling relation relative to the conveyor, and wherein the speed control assembly permits the conveyor to move at a first given speed if a first condition is sensed at the rotation means, and further permits the conveyor to move at a second given speed if a second condition is sensed at the rotation means, and wherein the second given speed is less than the first given speed.

BRIEF DESCRIPTION OF THE DRAWINGS

FIG. 6 is a fragmentary, side elevation view of an electrical control panel utilized with the refuse assembly of the present invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
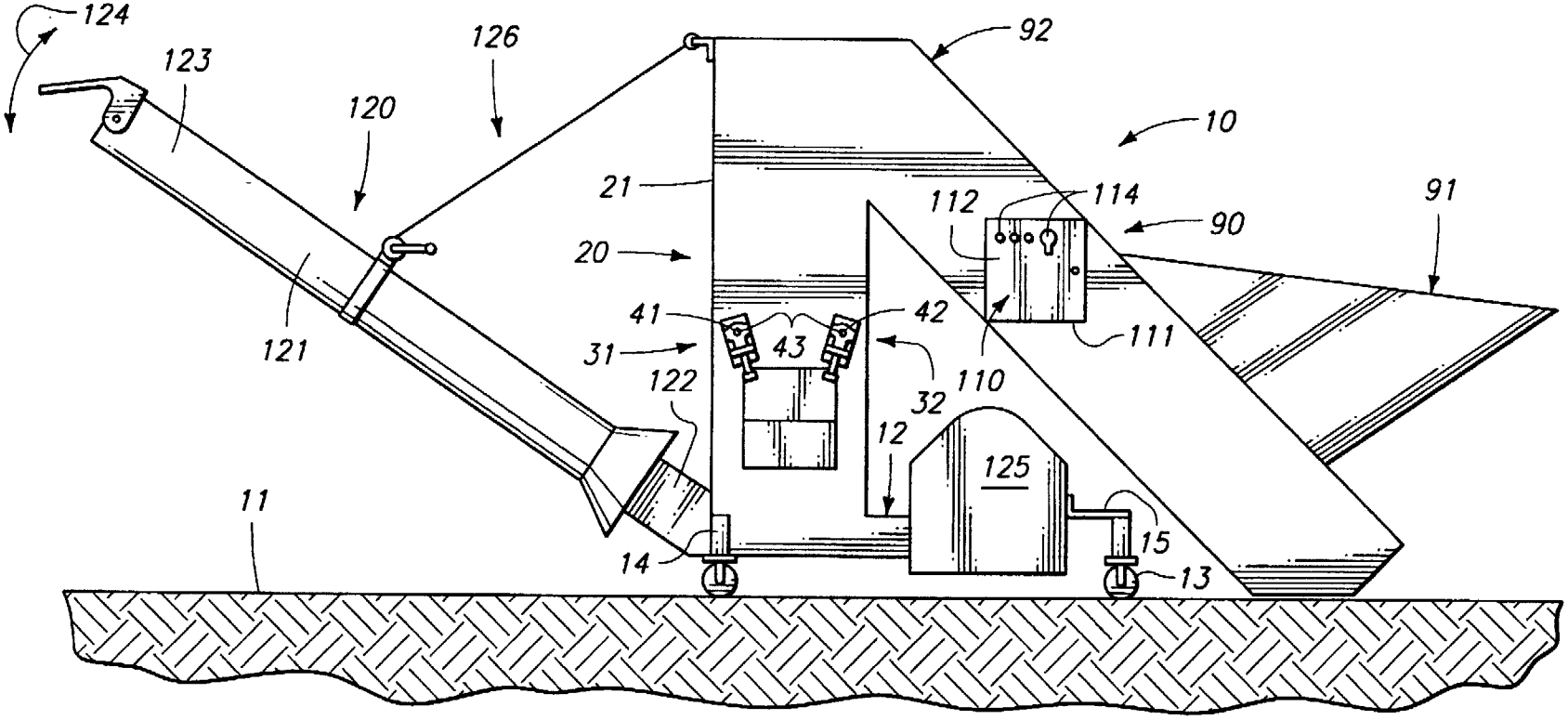
FIG. 1 is a side elevation view of the refuse assembly of the present invention.
Figure 2:
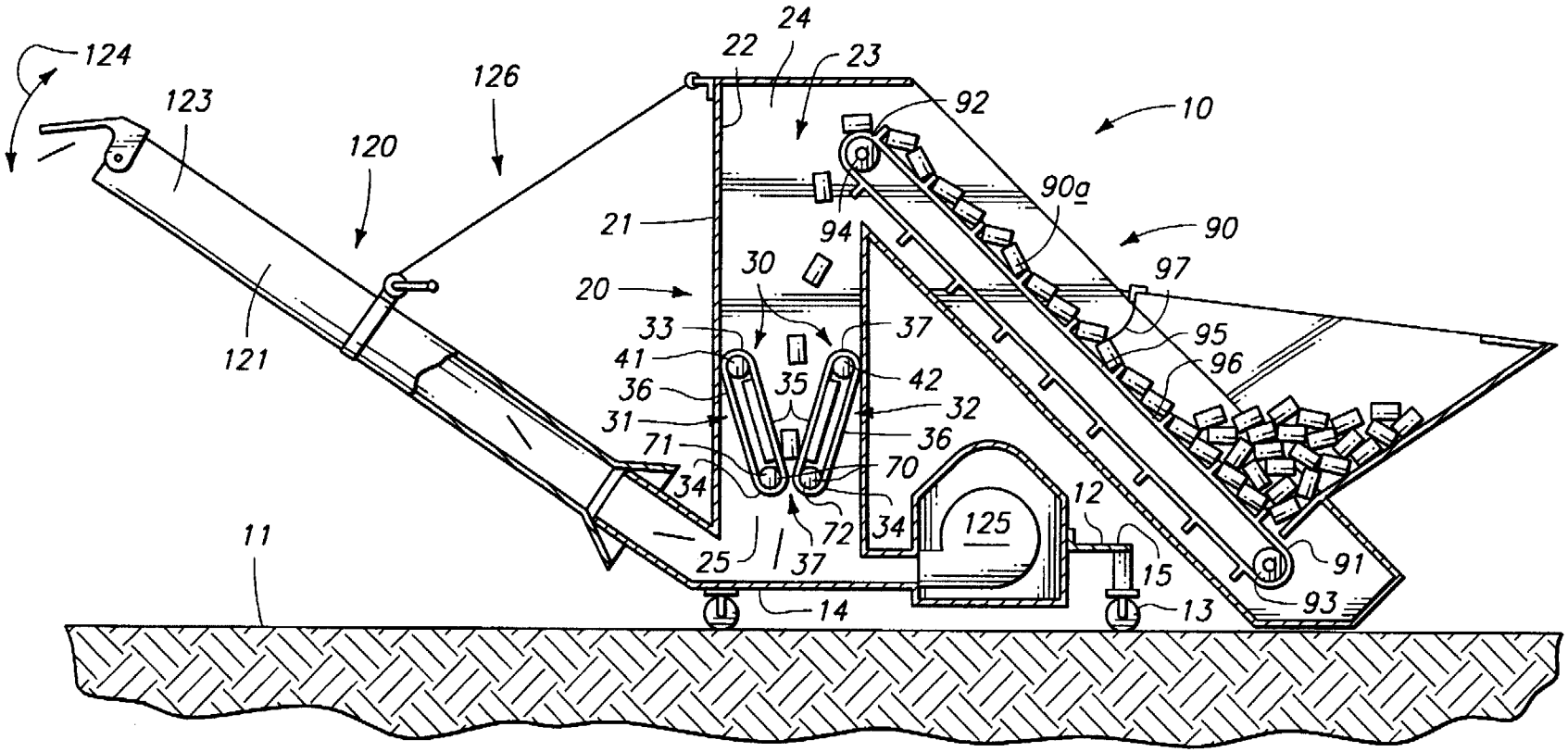
FIG. 2 is a partial, longitudinal, vertical sectional view of the refuse assembly.

Referring now to FIG. 1, the refuse assembly of the present invention is generally indicated by the numeral 10. The refuse assembly is operable for movement across the surface of the earth 11. In this regard, the refuse assembly 10 movably engages the surface of the earth 11 by means of a chassis 12 which is supported in spaced relation relative to the surface of the earth 11 by means of a plurality of casters 13, and which are affixed on the chassis 12 by a suitable fastening technique such as by welding or the like. The chassis 12 has a first, or forward end 14, and an opposite, second or distal end 15. The casters 13 facilitate the movement of the refuse assembly 10 from one location to another. Mounted on the first end of the chassis 12 is a housing or frame 20. As seen in FIG. 2, the housing or frame 20 has an exterior facing surface 21, and an opposite interior facing surface 22 which defines a passageway 23 having a predetermined cross sectional dimension. The passageway has an upper or intake end 24 and a lower or exhaust end 25.

Figure 3:
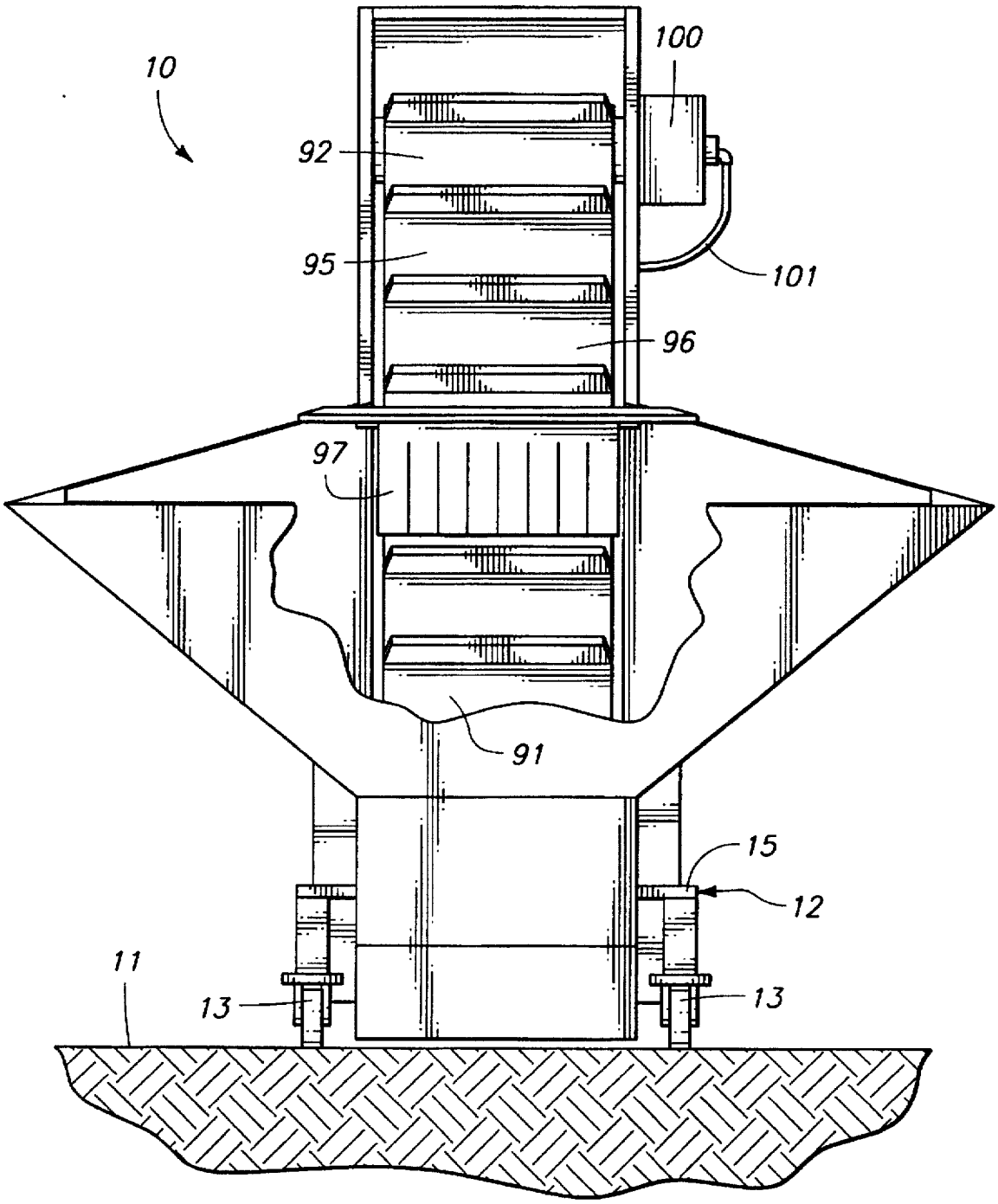
FIG. 3 is a fragmentary, end view of refuse assembly of the present invention.
Figure 4:
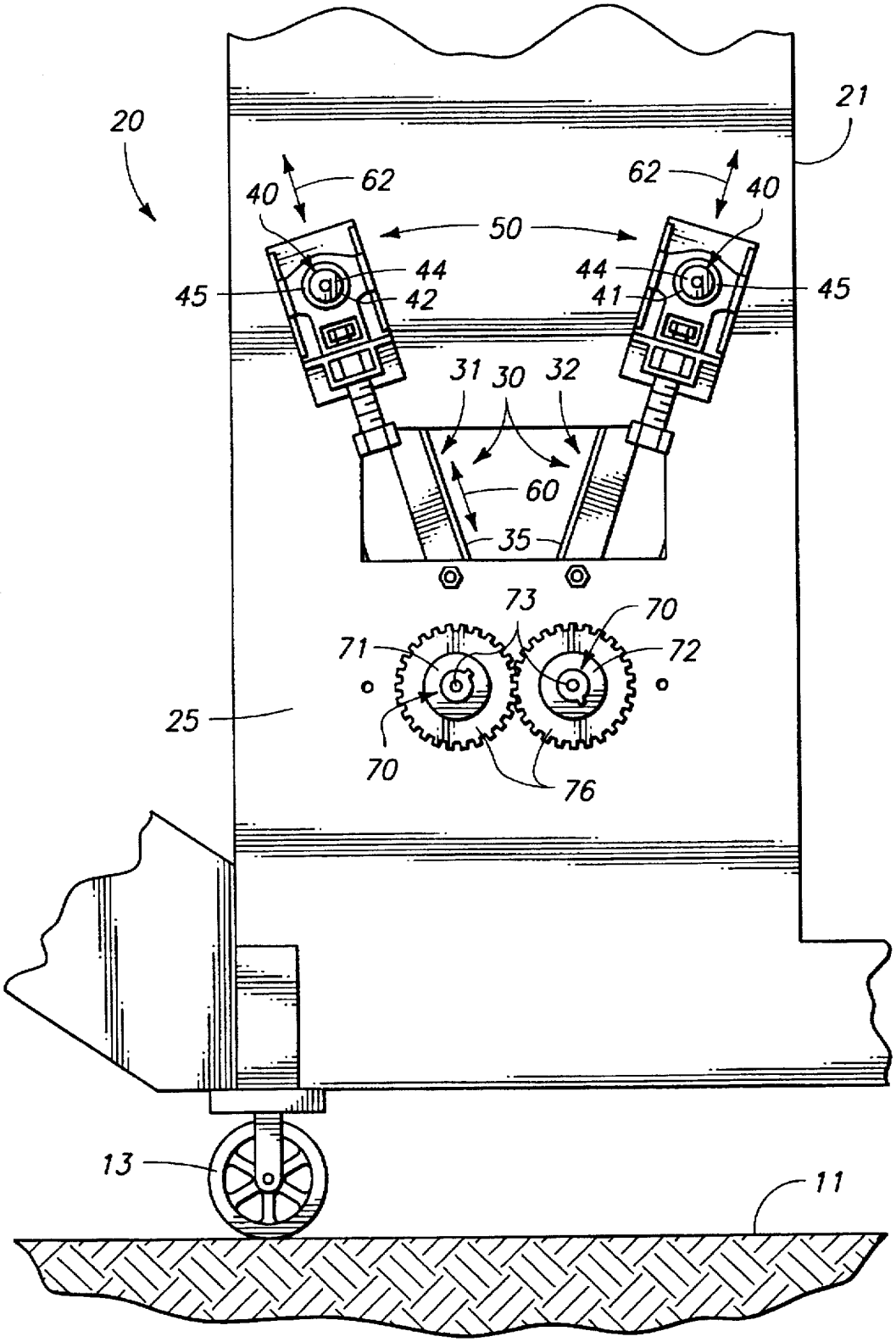
FIG. 4 is a fragmentary, side elevation view of the refuse assembly of the present invention with some supporting surfaces removed to show the structure thereunder.
Figure 5:
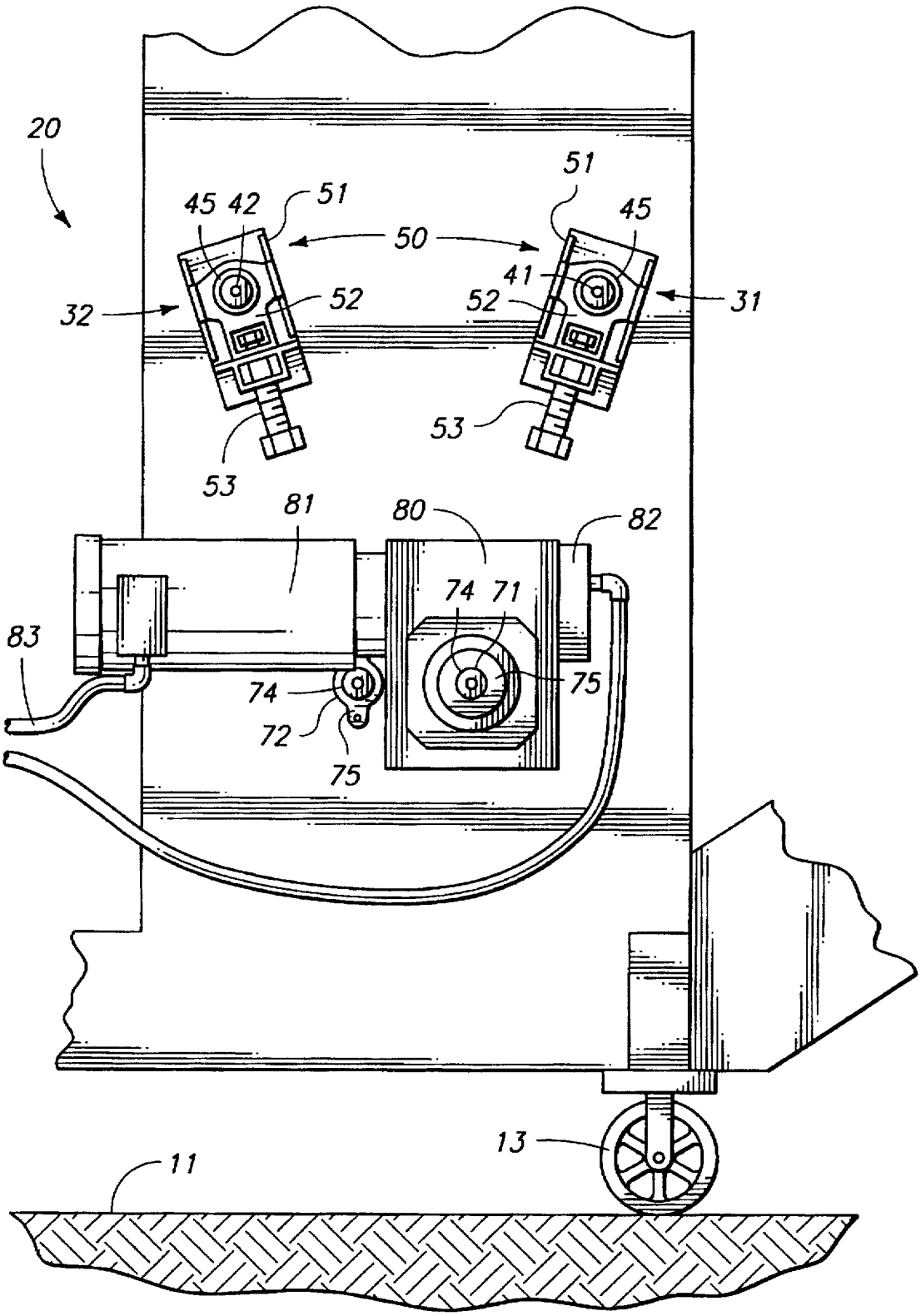
FIG. 5 is a fragmentary, side elevation view of the refuse assembly taken from a position opposite to that shown in FIG. 4.
Figure 11:
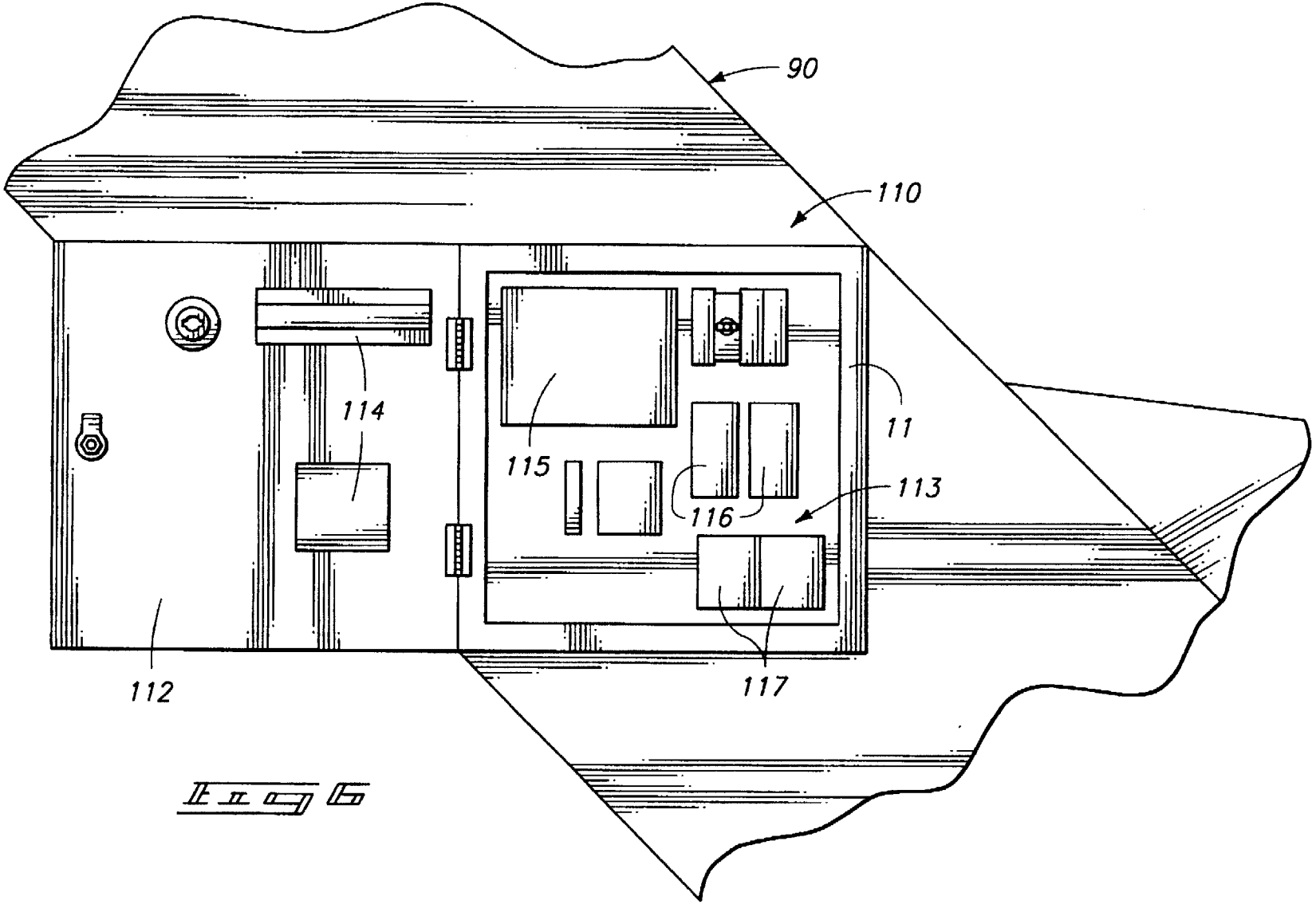

As best seen in FIGS. 2 and 4, a pair of continuous rotatable belts 30 are mounted in converging relation one to the other in the passageway 23. The pair of continuous belts 30 partially occlude the passageway 23. Each of the continuous belts which are designated hereinafter as a first belt 31, and a second belt 32, have an upstream end 33, and an opposite downstream end 34. As best seen in FIG. 4, the upstream end 33 is movably mounted near the intake end 24 of the passageway 23, and the downstream end is substantially fixedly mounted near the exhaust end 25 of the passageway. Each of the respective first and second continuous rotatable belts 31 and 32 have an inner facing course 35, and an outer facing course 36. Further, it should be recognized that the downstream ends 34 are disposed in predetermined spaced relation one to the other, thereby defining an aperture 37 therebetween. The cross sectional dimensions of the aperture 37 is less than the cross sectional dimensions of the passageway 23. As will be recognized from a study of FIGS. 2 and 4, the individual continuous rotatable belts 31 and 32 each have an idler roller 40 which is rotatably mounted on the upstream end of each of the belts. The idler rollers are hereinafter identified as a first idler roller 41, and a second idler roller 42. Each of the respective idler rollers have opposite first and second ends 43 and 44, respectively, which are suitably received in bearings 45 of conventional design. As seen in FIGS. 4 and 5, respectively, the first and second ends 43 and 44 of the respective idler rollers 40 are received in a tension mechanism 50 which is affixed on the exterior facing surface 21 of the housing 20. The tension mechanism is of conventional design having a frame 51 which slidably receives a bearing engagement member 52. A threaded adjustment member 53 exerts force on the bearing engagement member thereby moving it along a given course of travel. By advancing the threaded adjustment member 53, the tension on the first and second continuous rotatable belts 31 and 32 can be appropriated adjusted. As will be recognized from a study of FIG. 3, each of the first and second continuous rotatable belts 31, and 32 have a major longitudinal axis 60. In this regard, the upstream ends 33 of the respective pair of continuous rotatable belts 30 are individually adjustably movable along courses of travel 62 which are substantially coaxially aligned with the major longitudinal axis 60.

As best seen in FIG. 4, the refuse assembly 10 includes a pair of drive rollers 70 which are individually rotatably mounted on the downstream end 34 of the respective first and second continuous rotatable belts 31 and 32 respectively. The pair of drive rollers include a first drive roller 71, and a second drive roller 72, which is spaced a predetermined distance therefrom. Both drive rollers 71 and 72 have opposite first and second ends 73 and 74, respectively. Each of the first and second ends 73 and 74 are received in conventionally designed bearings 75. As best seen in FIG. 4, a pair of gears 76 are individually fixedly mounted on the first end 73 of each of the first and second drive rollers 71 and 72, respectively. The gears 76 meshingly cooperate together. Further, as shown in FIG. 5, a gear reduction assembly 80 is mounted on the second end 74 of the first drive roller 71. Further, a first motor 81 is disposed in force transmitting relation relative to the gear reduction assembly 81. Still further, an encoder 82 is made integral with the first motor 81, and is operable to sense the load experienced by the first motor 81 as it drives the pair of continuous rotatable belts. An electrical conduit 83 connects the first motor 81 and the encoder 82 with an operations panel which will be discussed in greater detail hereinafter.

As best seen by reference to the FIG. 1, the refuse assembly 10 of the present invention includes a first conveyor assembly which is generally indicated by the numeral 90. The first conveyor assembly 90 has a first or intake end 91, and an opposite, second or discharging end 92 which is disposed in gravity feeding relation relative to the intake end 24 of the passageway 23. The first conveyor assembly 90 carries or otherwise transports the objects of interest such as metal beverage containers 90A to the intake end of the passageway. The first conveyor assembly 90 has an idler roller 93 which is located on the first or intake end 91, and has an opposite, second, or drive roller 94 which is mounted on the second or discharge end thereof. The first conveyor assembly 90 has a continuous belt 95 which is received about the idler, and drive rollers and which includes an upper or first course 96 which carries or otherwise supports the objects of interest to the intake end of the passageway. As best seen by reference to FIGS. 2 and 3, a sweeping assembly 96 is mounted atop, and in spaced relation to the first course 96. The sweeping assembly is operable to insure that the objects being carried on the first course do not exceed a given height. The sweeping assembly is manufactured from a resilient, synthetic material.

As best seen by reference to FIG. 3, a second motor 100 is disposed in force transmitting relation relative to the drive roller 94. The second motor 100 is a variable speed motor which is electrically coupled, by means of an electrical conduit 101, with a control panel or assembly which is generally indicated by the numeral 110. The control panel, or assembly 110 is borne by the housing 20 and placed within an enclosure 111. The enclosure 111 includes a door 112 which allows access to a cavity 113 which is defined by the enclosure 111. Mounted on the door 112 for ready access to an operator, (not shown), is a plurality of switch assemblies 114 which allow the operator to energize or otherwise adjust various operational features of the refuse assembly 10.

For example, one of the features of the present refuse assembly is a subassembly assembly made integral with the control panel 110? which permits the direction of rotation of the continuous rotatable belts 30 to be reversed. During normal operation, the continuous rotatable belts counter rotate, one to the other, and are operable to carry the objects along the passageway, and in the direction of discharge end 25 thereof. As the objects pass in the direction of the discharge end 25, the continuous rotatable belts are effective in applying force to reduce the size of the objects.

Further, and placed internally of the enclosure 11, the control assembly includes a signal transmitter 115 which converts the shaft rotation of the first motor 81 to a linear current or voltage output. A suitable signal transmitter may be purchased from Process Control Systems, Inc. of Minneapolis, Minn. under the trade name Maxigard. The present signal transmitter is operable to measure the amount of load experienced by the first motor 81 during operation. When minimal load is experienced by the first motor 81, this represents a first operational condition of the device. Once load of a predetermined magnitude is experienced by the first motor, the signal transmitter is operable to provide suitable electrical signals, which are coupled, by means of relays 116, to the variable speed drive 117. Upon receiving these signals, the variable speed drive 117 reduces the speed of the second electric motor 100 by a given amount. In this way, the maximum throughput for the refuse assembly 10 can be realized without risking damage to the refuse assembly 10 which is occasioned by blockage, or merely overloading the device. The specific operation of the present refuse assembly 10 will be discussed in greater detail hereinafter. As should be understood, the load experienced by the first motor is a function of the number of objects, such as beverage cans 90A which are moving along the passageway 23. As the numbers of beverage cans increase, the continuous rotatable belts experience increased function, and thus the load on first motor increases. In the present invention, the first load and second load conditions are determined based upon the size of elective motor 81 employed.

As best seen by reference to FIG. 2, a second conveyor assembly 120 is mounted in receiving relation relative to the exhaust end 25 of the passageway 23. The second conveyor assembly 120 comprises a conduit 121 which has a first or proximal end 122, which is disposed in gravity receiving relation relative to the exhaust end of the passageway 25, and an opposite, second, or distal end 123. The conduit 121 is operable to receive a stream of fluid which will carry the objects of interest to a predetermined location. Still further, the second or distal end 123 is operable to move along a given course of travel thereby allowing an operator (not shown) to orient the second end in a predetermined location. As will be seen in FIG. 1, a blower assembly 125, of conventional design, is mounted endwardly of the first end 122 and is effective to produce a stream of air which moves down the conduit. The stream of air carries the objects to the distal end thereof. A winch assembly 126 is provided to adjustably support the conduit 121 in a given orientation.

OPERATION

The operation of the described embodiment of the present invention is believed to be readily apparent is briefly summarized at this point.

As best seen by reference to FIGS. 1, 2 and 3, the refuse assembly 10 for reducing the size of deformable objects such as metal beverage cans 90A and the like comprises a frame 20 having a passageway 23. The passageway 23 has an intake end 24, and an opposite, exhaust end 25. A pair of continuous rotatable belts 30 are mounted in converging relation, one to the other, in the passageway 23. The pair of continuous belts 30 partially occlude the passageway 23, each of the continuous belts having an upstream end 33, which is movably mounted near the intake end 24 of the passageway 23, and a downstream end, 34, which is substantially fixedly mounted near the exhaust end 25 of the passageway 23. As best seen in FIG. 5, a rotation means is mounted in force transmitting relative to the respective continuous belts to rotate each of the continuous belts in a predetermined direction. In the preferred embodiment of the invention 10, the rotation means comprises a first engine 81 which is disposed in force transmitting relation relative to the first drive roller 71. As seen in FIG. 4, a pair of gears 76 are individually mounted endwardly of each of the drive rollers 70. The gears 76 mesh together such that when rotational force is imparted by the first engine 81 to the drive roller 71, it causes the other drive roller 72 to counter rotate relative to same. Such counter rotation has the effect of causing the pair of continuous rotatable belts to carry the beverage containers in the direction of the discharge end of the passageway. When the cans emerge from the aperture 37, they are reduced in size.

As best appreciated by a study of FIG. 2, a first conveyor assembly 90 is mounted in discharging relation relative to the intake end 24 of the passageway 23. The first conveyor assembly 90 carries the objects of interest to the intake end 24 of the passageway 23 where they move under the influence of gravity into the intake end of the passageway. Upon falling into the passageway the objects move, under the influence of gravity, into contact with the pair of continuous belts 30. Once in contact with the pair of continuous belts, the individual continuous belts rotate in a given direction which carries the objects in the direction of the exhaust end 25 of the passageway. The continuous belts 30 apply force to the objects 90A which is effective to reduce the size of each of the objects. The objects pass through the aperture 37 and to the exhaust end of the passageway. As earlier discussed, and as seen in FIG. 3, the second engine 100 is disposed in driving relation relative to the drive roller 94 which is mounted on the discharge end 92 of the first conveyor 90. The refuse assembly 10 further includes a control assembly 110 which is disposed in sensing relation relative to the first engine 81, and in speed controlling relation relative to the second engine 100. The control assembly 110 permits the first conveyor 90 to move at a first given speed if a first load condition is sensed at the first engine, and further permits the first conveyor to move at a second given speed if a second load condition is sensed at the first engine. The second given speed is less than the first given speed.

The refuse assembly 10 further includes a second conveyor assembly 120 which is disposed in receiving relation relative to the exhaust end 25 of the passageway 23. The second conveyor assembly carries the objects to a predetermined destination. In the preferred embodiment of the present invention, the second conveyor comprises a conduit 121 which receives a stream of fluid which carries the objects along the conduit. Most preferably, the second conveyor comprises a conduit 121 which has a blower assembly 125 mounted endwardly thereof, and which provides a supply of air under pressure which propels the objects along the conduit to the distal end 123 thereof.

In the preferred form of the present invention, the refuse assembly for reducing the size of deformable objects comprises a frame 20 defining a passageway 23 through which the objects 90A pass, the objects moving through the passageway under the influence of gravity. The passageway 23 has an intake end 24, and an opposite, exhaust end 25. A pair of continuous rotatable belts 30 are mounted in the passageway 23. The pair of continuous belts are disposed in converging relation, one to the other. The individual belts 30 each have an upstream end 33 which is located in a position which is near the intake end 24 of the passageway 23, and an opposite, downstream end 34, which is located in a position near the exhaust end 25 of the passageway. The downstream ends 34 of the respective continuous belts 30 are mounted in substantially fixed spaced relation, one to the other, and the upstream ends 33 are adjustably movable along predetermined courses of travel 62. Each of the continuous belts 30 has a drive roller 70 and an idler roller 40. Each of the drive rollers 70 are disposed on the downstream end 34 of the individual continuous belts. The idler rollers 40 on the other hand, are borne on the upstream end 33 of each of the continuous belts. As best seen in FIG. 4, a pair of gears 76 are individually mounted endwardly of each of the drive rollers. The gears matingly cooperate together such that when rotational force is imparted to one of the drive rollers, the other drive roller counter rotates relative to same. A first engine 81 is disposed in force transmitting relation relative to the pair of continuous belts 30. The first engine 81 rotates the pair of continuous belts in a predetermined direction which facilitates the movement of the objects 90A in the direction of the exhaust end 25 of the passageway 23.

A first conveyor is mounted in discharging relation relative to the intake end 24 of the passageway 23. The first conveyor 90 carries the objects to the passageway 23 at a predetermined speed. A second engine 100 is mounted in force transmitting relation relative to the first conveyor. The second engine propels the conveyor at the predetermined speed.

A speed control assembly 110 is disposed in load sensing relation relative to the first engine 81, and is further disposed in speed controlling relation relative to the second engine 100. The speed control assembly permits the first conveyor 90 to move at a first given speed if a first load condition is sensed at the first engine 81, and permits the first conveyor 90 to move at a second, reduced speed if a second increased load condition is sensed by the first engine. A second conveyor 120 is disposed in receiving relation relative to the exhaust end 25 of the passageway 23. The second conveyor 120 carries the objects 90A to a predetermined destination.

Therefore, it will be seen that the refuse assembly 10 of the present invention provides a convenient, and reliable means by which deformable objects, such as metal containers and the like, may be reduced in size and transported to a predetermined location in a fashion which reduces the problems associated with the earlier prior art devices practices.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the Doctrine of Equivalents.

I claim:

1. A refuse assembly for reducing the size of deformable objects, the refuse assembly comprising:

a frame defining a passageway, the passageway having an intake end, and an opposite exhaust end;

a pair of continuous rotatable belts mounted in converging relation, one to the other, in the passageway, the pair of continuous belts partially occluding the passageway, each of the continuous belts having an upstream end which is movably mounted near the intake end of the passageway, and a downstream end which is substantially fixedly mounted near the exhaust end of the passageway;

means mounted in force transmitting relation relative to the respective continuous belts to rotate each of the continuous belts in a predetermined direction; and means for controlling the direction of rotation of the individual continuous belts disposed in signal transmitting relation relative to the rotation means, the controlling means operable to change the direction of rotation of the pair of continuous belts.

2. A refuse assembly for reducing the size of deformable objects, the refuse assembly comprising:

a frame defining a passageway, the passageway having an intake end, and an opposite exhaust end;

a pair of continuous rotatable belts mounted in converging relation, one to the other, in the passageway, the pair of continuous belts partially occluding the passageway, each of the continuous belts having an upstream end which is movably mounted near the intake end of the passageway, and a downstream end which is substantially fixedly mounted near the exhaust end of the passageway, and wherein each of the continuous belts has a drive roller, and an idler roller, and wherein the drive roller is borne on the downstream end of each of the continuous belts, and the idler roller is borne on the upstream end of each of the continuous belts;

means mounted in force transmitting relation relative to the respective continuous belts to rotate each of the continuous belts in a predetermined direction;

a first conveyor assembly mounted in discharging relation relative to the intake end of the passageway, the first conveyor assembly carrying the objects to the intake end of the passageway where they move under the influence of gravity into the intake end of the passageway;

an engine mounted in force transmitting relation relative to the first conveyor assembly, the engine causing the first conveyor to carry the objects in the direction of the intake end of the passageway, and wherein the speed of movement of the objects carried by the first conveyor is adjustable.

3. A refuse assembly as claimed in claim 2, and which further comprises a speed control assembly disposed in sensing relation relative to the rotation means, and in speed controlling relation relative to the engine, and wherein the speed control assembly permits the first conveyor to move at a first given speed, if a first condition is sensed at the rotation means, and permits the first conveyor to move at a second given speed if a second condition is sensed at the rotation means, and wherein the second given speed is less than the first given speed.

4. A refuse assembly as claimed in claim 3, wherein the rotation means and the engine comprise individual first and second electric engines, and wherein the speed control assembly comprises a variable speed electric drive which is disposed in load sensing relation relative to the first engine and in adjustable speed controlling relation relative to the second engine.

5. A refuse assembly as claimed in claim 4, wherein the first conveyor is an endless belt, and the objects are carried along on the endless belt, and wherein as the objects are supplied to the intake end of the passageway they fall, under the influence of gravity, into contact with the pair of continuous belts, and wherein the individual continuous belts rotate in a given direction which carries the objects in the direction of the exhaust end of the passageway, the continuous belts applying force to the objects which is effective to reduce the size of the objects.

6. A refuse assembly as claimed in claim 5, wherein the drive rollers are disposed in substantially fixed, spaced relation one to the other, the individual drive rollers defining an aperture therebetween which has a cross sectional area which is less than the cross sectional area of the passageway, the objects passing through the aperture, and wherein the first engine is borne by the frame and disposed in force transmitting relation relative to one of the drive rollers, and wherein a pair of gears are individually mounted endwardly of each of the drive rollers, the gears matingly cooperating together, and wherein rotational force imparted by the first engine to one of the drive rollers causes the other drive roller to rotate.

7. A refuse assembly as claimed in claim 6, wherein a second conveyor is disposed in receiving relation relative to the discharge end of the passageway, the second conveyor carrying the objects to a predetermined destination.

8. A refuse assembly as claimed in claim 7, wherein the second conveyor comprises a conduit, and a stream of fluid is supplied to the conduit, the supply of fluid carrying the objects along the conduit.

9. A refuse assembly for reducing the size of deformable objects, comprising:

a frame defining a passageway through which the objects pass, the objects moving through the passageway under the influence of gravity, the passageway having an intake end, an opposite, exhaust end;

a pair of continuous rotatable belts mounted in the passageway, the pair of continuous belts disposed in converging relation, one to the other, the individual belts each having an upstream end which is located in a position which is near the intake end of the passageway, and an opposite downstream end which is located in a position near the exhaust end of the passageway, and wherein the downstream ends of the respective continuous belts are mounted in substantially fixed spaced relation, one to the other, and the upstream ends are adjustably moveable along predetermined paths of travel;

a rotation means disposed in force transmitting relation relative to the pair of continuous belts, the rotation means rotating the continuous belts in a predetermined direction;

a conveyor mounted in discharging relation relative to the intake end of the passageway, the conveyor carrying the objects to the passageway at a predetermined speed; and a speed control assembly disposed in sensing relation relative to the rotation means, and in speed controlling relation relative to the conveyor, and wherein the speed control assembly permits the conveyor to move at a first given speed, if a first condition is sensed at the rotation means, and further permits the conveyor to move at a second given speed if a second condition is sensed at the rotation means, and wherein the second given speed is less than the first given speed.

10. A refuse assembly as claimed in claim 9, wherein each of the continuous belts has a drive roller and an idler roller, and wherein the drive roller is borne on the downstream end of each of the continuous belts, and the idler roller is borne on the upstream end of each of the continuous belts.

11. A refuse assembly as claimed in claim 10, wherein the drive rollers are disposed in substantially fixed, spaced relation one to the other, the individual drive rollers defining an aperture therebetween which has a cross sectional area which is less than the cross sectional area of the passageway, the objects passing through the aperture, and wherein the rotation means comprises a first engine borne by the frame and disposed in force transmitting relation relative to one of the drive rollers, and wherein a pair of gears are individually mounted endwardly of each of the drive rollers, the gears matingly cooperating together, and wherein rotational force imparted by the first engine to one of the drive rollers causes the other drive roller to rotate.

12. A refuse assembly as claimed in claim 11, wherein the conveyor comprises a continuous belt, and a second engine is borne by the conveyor and is effective to rotate the continuous belt of the conveyor in a given direction, and wherein the speed control assembly comprises a variable speed drive which is disposed in load sensing relation relative to the first engine, and in adjustable speed controlling relation relative to the second engine.

13. A refuse assembly as claimed in claim 12, wherein each of the continuous belts has a major longitudinal axis, and a minor transverse axis, and wherein the upstream ends of each of the continuous belts are individually adjustably moveable along courses of travel which are substantially coaxially aligned with the major longitudinal axis.

14. A refuse assembly as claimed in claim 13, wherein the pair of continuous rotatable belts counter rotate one to the other.

15. A refuse assembly as claimed in claim 14, and which further comprises a directional control assembly which is effective to control the direction of rotation of the pair of continuous belts.

16. A refuse assembly as claimed in 15, wherein the conveyor carries a predetermined number of objects to the intake end of the passageway at the first given speed, and wherein the movement of the objects through the passageway results in a predetermined load sensed by the first engine, and wherein the speed control assembly, upon sensing a given load on the first engine, causes the second engine to operate at the second given speed.

17. A refuse assembly as claimed in claim 16, wherein a second conveyor is disposed in receiving relation relative to the discharge end of the passageway, the second conveyor carrying the objects to a predetermined destination.

18. A refuse assembly as claimed in claim 17, wherein the second conveyor comprises a conduit, and a stream of fluid is supplied to the conduit, the supply of fluid carrying the objects along the conduit.

19. A refuse assembly as claimed in claim 18, wherein the steam of fluid is air which is propelled by a blower assembly which is mounted endwardly of the conduit, and wherein the conduit is adjustably moveable into various positions.

20. A refuse assembly for reducing the size of deformable objects, comprising:

a frame defining a passageway through which the objects pass, the objects moving through the passageway under the influence of gravity, the passageway having an intake end an opposite, exhaust end;

a pair of continuous rotatable belts mounted in the passageway, the pair of continuous belts disposed in converging relation, one to the other, the individual belts each having an upstream end, which is located in a position which is near the intake end of the passageway, and an opposite, downstream end which is located in a position near the exhaust end of the passageway, and wherein the downstream ends of the respective continuous belts are mounted in substantially fixed, spaced relation, one to the other, and the upstream ends are adjustably moveable along predetermined paths of travel, and wherein each of the continuous belts has a drive roller, and an idler roller and wherein the drive roller is disposed on the downstream end of each of the continuous belts, and the idler roller is borne on the upstream end of each of continuous belts, and wherein a pair of gears are individually mounted endwardly of each of the drive rollers, the gears matingly cooperating together, and wherein rotational force imparted to one of the drive rollers causes the other drive roller to rotate;

a first engine disposed in force transmitting relation relative to one of the pair of continuous belts, the first engine rotating the pair of continuous belts in a predetermined direction;

a first conveyor mounted in discharging relation relative to the intake end of the passageway, the conveyor carrying the objects to the passageway at a predetermined speed;

a second engine mounted in force transmitting relation relative to the first conveyor, the second engine propelling the conveyor at the predetermined speed;

a speed control assembly disposed in load sensing relation relative to the first engine and in speed controlling relation relative to the second engine, and wherein the speed control assembly permits the first conveyor to move at a first given speed, if a first load condition is sensed at the first engine, and further permits the conveyor to move at a second, reduced speed, if a second increased load condition is sensed at the rotation means; and a second conveyor disposed in receiving relation relative to the discharge end of the passageway, the second conveyor carrying the objects to a predetermined destination.

21. A refuse assembly for reducing the size of deformable objects comprising:

a frame defining a passageway;

a pair of continuous rotatable belts mounted in converging relation in the passageway;

means for rotating the individual continuous belts in a predetermined direction; and means for controlling the direction of rotation of the individual continuous belts.

* * * * *